US005955413A

United States Patent [19]

Campagna et al.

[11] Patent Number: 5,955,413

[45] Date of Patent: Sep. 21, 1999

[54] CARPET CLEANING AND REAPPLICATION SYSTEM BASED ON METHACRYLIC ACID POLYMER, SEQUESTRANT, AND ANIONIC SURFACTANT

[75] Inventors: Jason A. Campagna, Roseville; Richard S. Smith, West St. Paul, both of Minn.

[73] Assignee: 3M Innovative Properties Company, St. Paul, Minn.

[21] Appl. No.: 08/957,266

[22] Filed: Oct. 24, 1997

[51] Int. Cl.[6] ..... C11D 3/37; C11D 3/065; C11D 3/60; D06M 10/10

[52] U.S. Cl. ..... 510/278; 8/115.56; 8/137; 8/149.1; 8/149.3; 510/280; 510/299; 510/357; 510/359; 510/361; 510/400; 510/434; 510/476

[58] Field of Search ..... 510/278, 279, 510/280, 476, 361, 299, 400, 528, 495, 426, 357, 359, 434, 533; 8/115.56, 137, 149.1, 149.3

[56] References Cited

U.S. PATENT DOCUMENTS

| | | | |
|---|---|---|---|
| 3,150,096 | 9/1964 | Schmidt et al. | 252/106 |
| 3,723,323 | 3/1973 | Morgan et al. | 510/279 |
| 3,723,358 | 3/1973 | Morgan et al. | 510/279 |
| 3,736,259 | 5/1973 | Buck et al. | 252/89 |
| 4,013,595 | 3/1977 | Podella et al. | 510/279 |
| 4,035,148 | 7/1977 | Metzger et al. | 8/137 |
| 4,090,974 | 5/1978 | Morganson | 252/135 |
| 4,203,859 | 5/1980 | Kirn et al. | 252/174.23 |
| 4,336,165 | 6/1982 | Weisensel | 252/528 |
| 4,725,319 | 2/1988 | Osberghaus | 134/4 |
| 4,822,373 | 4/1989 | Olson et al. | 8/115.6 |
| 4,925,707 | 5/1990 | Vinod | 427/393.4 |
| 4,937,123 | 6/1990 | Chang et al. | 428/96 |
| 5,001,004 | 3/1991 | Fitzgerald et al. | 428/263 |
| 5,009,667 | 4/1991 | Beck et al. | 8/115.56 |
| 5,137,759 | 8/1992 | Vinod | 427/393.4 |
| 5,212,272 | 5/1993 | Sargent et al. | 526/317.1 |
| 5,252,232 | 10/1993 | Vinod | 252/8.6 |
| 5,429,684 | 7/1995 | Osberghaus et al. | 134/3 |
| 5,439,610 | 8/1995 | Ryan et al. | 252/174.23 |
| 5,460,887 | 10/1995 | Pichhold | 428/395 |
| 5,514,302 | 5/1996 | Brown | 252/545 |
| 5,516,337 | 5/1996 | Nguyen | 8/557 |
| 5,534,167 | 7/1996 | Billman | 510/280 |
| 5,545,352 | 8/1996 | Pike | 510/514 |
| 5,629,376 | 5/1997 | Sargent et al. | 524/745 |
| 5,759,431 | 6/1998 | Nguyen | 252/8.62 |

FOREIGN PATENT DOCUMENTS

| | | | |
|---|---|---|---|
| WO 96/11249 | 4/1996 | WIPO | C11D 1/75 |

OTHER PUBLICATIONS

Shampooing Carpet Samples with Carpet Board Cleaning Machine, Floorcovering Test Methods, CPT 106–1995 (Apr. 21, 1995).

*Primary Examiner*—Ardith Hertzog
*Attorney, Agent, or Firm*—Daniel C. Schulte

[57] ABSTRACT

Organic solvent free carpet cleaning compositions maintain the stainblocking properties of factory applied treatments. The compositions contain a methacrylic acid polymer component, a sequestering agent, an anionic surfactant, and optionally water.

42 Claims, No Drawings

CARPET CLEANING AND REAPPLICATION SYSTEM BASED ON METHACRYLIC ACID POLYMER, SEQUESTRANT, AND ANIONIC SURFACTANT

FIELD OF THE INVENTION

This invention relates to a solventless cleaning and reapplication system for carpet which provides good cleaning performance while maintaining stainblocking properties of the carpet.

BACKGROUND OF THE INVENTION

For many decades, carpet has been the floor covering of choice for improving both the aesthetics and comfort of rooms in commercial buildings and residential homes. Though very pleasing in appearance and hand when new, the carpet over time inevitably is stained by foods and beverages and also becomes discolored due to soil pick-up caused by foot traffic. Various treatments have been applied to carpet to minimize the effect of these assaults. Such treatments include fluoroaliphatic compounds to provide water and oil repellency as well as soil resistance, and stainblockers to prevent adherence to, and a to facilitate release of, stains from polyamide fibers. However, though a treatment may show initial effectiveness, its efficacy gradually diminishes over time, at which point the carpet must be cleaned to restore its initial appearance. Unfortunately, during cleaning, such treatment can be removed from the carpet, leaving the carpet susceptible to accelerated discoloration from staining and soiling.

Various attempts have been made to minimize the detrimental effect cleaning systems have on the future appearance of the carpet (e.g., the loss of effectiveness of carpet treatments). For example, many different compositions have been applied to carpeting as various types of carpet treatments. As examples, some have used chemical compounds such as a number of specific sulfonated polymers, hydrolyzed vinyl aromatic-maleic anhydride polymers, and specific acrylic and olefinic polymers.

Still, there continues to be a need a carpet cleaning system that is essentially free of organic solvents, that can effectively clean carpet and, at that at the same time can provide a cleaned and treated carpet that exhibits stain blocking properties at a level shown by new carpeting.

SUMMARY OF THE INVENTION

The inventors have discovered a composition that effectively cleans carpet, wherein the cleaned carpet that continues to exhibit strong stainblocking properties.

Accordingly, the invention relates to a composition comprising (a) a methacrylic acid polymer component; (b) a sequestering agent; and (c) an anionic surfactant. Preferably, the composition comprises essentially no organic solvent; i.e., the composition is organic solvent-free. The composition of the invention can exist as a concentrate, or can be diluted with water to form an aqueous use dilution for use with traditional carpet cleaning equipment; within the present description, the term "composition" refers to both the concentrate and the aqueous use dilution.

The invention also provides a method of cleaning a fibrous polyamide substrate without substantial loss of stainblocking properties, the method comprising hot water extracting the substrate with a composition comprising (a) a methacrylic acid polymer component; (b) a sequestering agent; and (c) an anionic surfactant, and allowing the substrate to dry.

As used herein, "organic solvent-free" means that the composition contains substantially no volatile organic solvents, and has essentially zero emissions of such solvents.

The terms "carpet" and "fibrous polyamide substrate" are used interchangeably.

All percentages are weight percentages based on the total composition weight unless otherwise specified.

DETAILED DESCRIPTION

The methacrylic acid polymer is believed to be primarily responsible for the ability of the inventive compositions to maintain (or prevent loss of) stainblocking properties of factory applied treatments while cleaning carpet. In general, the methacrylic acid polymer component can be a homopolymer of methacrylic acid, or a copolymer comprising monomeric units derived from monomers comprising methacrylic acid and one or more ethylenically unsaturated comonomers, or mixtures of such homopolymer and copolymer(s).

Examples of useful comonomers include vinyl monomers; vinylidene monomers; monoolefinic and polyolefinic monomers; and heterocyclic monomers. Preferred comonomers include substituted or unsubstituted ethylenically unsaturated carboxylic acids or derivatives thereof. The carboxylic acids can be mono- or poly-carboxylic acids. Useful carboxylic acid derivatives include esters, amides, nitriles, and anhydrides.

Particularly preferred comonomers include, for example, alkyl acrylates having 1–4 carbon atoms (e.g., butyl acrylate), itaconic acid, sodium sulfostyrene and sulfated castor oil. U.S. Pat. No. 4,937,123 (Chang et al.) (incorporated herein by reference) describes methacrylic acid-based comonomers useful in this invention, along with procedures for preparing methacrylate homopolymers and copolymers. Suitable methacrylic acid-containing polymers are also commercially available under the Leukotan™ trade name from Rohm & Haas, Philadelphia, Pa.

The methacrylic acid polymer can be present in the composition in an amount which, upon cleaning carpet with the composition, provides at least partial maintenance of stainblocking properties of the carpet. If too little of the polymer is present, stainblocking properties can be diminished; if too much polymer is present, the carpet can have a stiff and unpleasant feel. The methacrylic acid polymer typically can make up from about 2 to 30 weight percent (wt-%) of a concentrate form of the composition, preferably about 3 to 20 wt-% and more preferably about 6 to 15 wt-%. When diluted with water to form an "aqueous use dilution," the methacrylic acid polymer can typically be present in an amount in the range from about 0.031 to 0.469 wt-%, preferably from about 0.047 to 0.313 wt-%, and more preferably from about 0.094 to 0.234 wt-% of the aqueous use dilution.

In addition to the methacrylic acid polymer, other chemicals considered in the carpet cleaning art to be stainblocking agents can be included in the composition (referred to herein as "secondary stainblocking agent"). Such secondary stainblocking agents can be, for example, a partially sulfonated aromatic condensation polymer such as 3M Brand Stain Release Concentrate FC-369, available from 3M Company, St. Paul, Minn. Another example of a useful secondary stainblocking agent is a hydrolyzed copolymer of maleic anhydride and ethylenically unsaturated aromatic or aliphatic monomers, as described in U.S. Pat. Nos. 5,001,004 (Fitzgerald et al.) and 5,460,887 (Pechhold), incorporated herein by reference. A preferred composition of the invention includes 3M Brand FC-661 Stain Release Concentrate, which contains a major amount of methacrylic acid polymer component and a minor amount of partially sulfonated novolak resin, and is commercially available from 3M Company.

A secondary stainblocking agent, if used, can generally be present in an amount in the range from about 0 to 10 wt-%, preferably about 1 to 5 wt-%, of a concentrate composition, and from about 0 to 0.156 wt-%, preferably 0.016 to 0.078 wt-%, of an aqueous use dilution. Within these ranges, it is preferred that the ratio of methacrylic acid polymer component to secondary stainblocking agent be in the range from about 1:0 to 1:1, and preferably about 6:1.

The composition also contains a sequestering agent to chelate hardness ions such as calcium, magnesium, iron, manganese and the like that might be present in an aqueous use dilution water and detract from the cleaning performance of the composition. The sequestering agent can be organic or inorganic. Organic sequestering agents include a broad range of materials that can complex hardness ions. These include EDTA and its salts, citric acid and its salts, boric acid and its salts, nitrilotriacetic acid and its salts, polyelectrolytes such as polyacrylic acid and its copolymers, polymaleic acid and its copolymers, and so on. Inorganic sequestering agents include condensed phosphates, particularly those of the formula $M-(PO_3M)_nOM$ wherein M is an alkali metal, n is a number ranging from 1 to about 60, typically less than 3 for non-cyclic phosphates. Examples of such phosphates include alkali metal orthophosphates such as sodium or potassium orthophosphate and alkali metal condensed phosphates (i.e., polyphosphates) such as sodium or potassium pyrophosphate, sodium tripolyphosphate, sodium hexametaphosphate and the like. A preferred sequestering agent is sodium tripolyphosphate, due to its sequestration and soil suspension properties. The sequestering agent can generally be present in an amount in the range from about 2 to 12 wt-% of a concentrate composition, preferably from about 3 to 9 wt-% and more preferably from about 5 to 7 wt-%. The sequestering agent can typically be present in an aqueous use dilution in an amount in the range from about 0.031 to 0.188 wt-%, preferably from about 0.031 to 0.141 wt-%, and more preferably from about 0.078 to 0.109 wt-%.

Any anionic surfactant can be used in the composition, so long as the anionic surfactant is compatible with the other elements of the composition, and provides detergency desired to clean a soiled carpet. These anionic surfactant or surfactants can contain one or two hydrophobic groups and one or two water-solubilizing anionic groups.

The hydrophobic group(s) should be large enough to make the surfactant sufficiently surface active, i.e., the total number of carbon atoms in all hydrophobic groups can preferably be at least 8. Examples of suitable hydrophobic groups include straight and branched octyl, decyl, lauryl (i.e., mostly dodecyl), myristyl (i.e., mostly tetradecyl), cetyl (i.e., mostly hexadecyl) and stearyl (i.e., mostly octadecyl); dodecylbenzyl, naphthyl, xylyl and diphenyl. Heteroatom-containing moieties may be present in the hydrophobic group, e.g., ester, amide and ether. When more than one hydrophobic group is present, the length of the chain may be relatively shorter (e.g., two n-butyl groups).

The water-solubilizing anionic group can preferably be sufficiently polar to effectively solubilize the surfactant in water to allow formation of micelles. Suitable water-solubilizing anionic groups include sulfonate, sulfate, and carboxylate. The positive counterion for the anionic group can be an alkali metal ion (e.g., $Na^+$, $K^+$ or $Li^+$), an alkaline earth metal ion (e.g., $Mg^{++}$ or $Ca^{++}$), or an ammonium ion (e.g., $NH_4^+$ or triethanolammonium). Optionally, the water-solubilizing anionic group can also contain a polyoxyethylene group of 1–15 monomeric units located between the hydrophobic group and the charged ionic group to form an ether sulfate, ether sulfonate or ether carboxylate group.

Examples of suitable anionic surfactants include sodium lauryl sulfate, sodium myristyl sulfate, sodium lauryl ether (2) sulfate (i.e., $C_{12}H_{25}(OCH_2CH_2)_2OSO_3^-Na^+$), sodium decyl sulfate, ammonium myristyl ether sulfate, sodium nonylphenol polyglycol ether (15) sulfate, sodium $C_6$–$C_8$ α-olefin sulfonate, sodium dodecylbenzenesulfonate, sodium naphthyl sulfonate, sodium dihexyl sulfosuccinate, sodium laurate, sodium stearate, sodium ether (5) stearate, potassium ricinoleate (potassium 12-hydroxy-9-octadecanoate), sodium myristoyl sarcosine and sodium N-methyl-N-oleyl taurate. The preferred surfactant is sodium xylene sulfonate. Such anionic surfactants are commercially available from many suppliers, many of whom are listed in the McCutcheon's Emulsifiers & Detergents directory, North America or International Editions (1996).

The anionic surfactant can generally be present in a concentrate composition in an amount in the range from about 0.5 to 10 wt-%, preferably from about 1 to 6 wt-%, and more preferably from about 2 to 4 wt-%. When used in the form of an aqueous use dilution, the surfactant can generally be present in an amount of about 0.008 to 0.156 wt-%, preferably about 0.016 to 0.094 wt-%, and more preferably about 0.031 to 0.063 wt-%.

Within the above specified ranges, it is preferred, but not required, that the ratio of stainblocker (methacrylic acid polymer, as well as any optional secondary stainblocking agent) to sequestering agent to surfactant be about 4:2:1 to 1:2:1, and preferably about 2:2:1.

The composition may optionally contain other ingredients, such as anti-foaming agents, fragrances, preservatives, and the like. If used, these added ingredients are typically present in relatively small amounts, such as about 0.05 to 0.20 wt-% of the composition in concentrate form, or from about 0.0008 to 0.0031 wt-% of the aqueous use dilution.

Although it is preferred and possible that the composition contain no organic solvent, it may be necessary that a very small amount of a compatible organic solvent be contained in the composition, e.g., because it has been included as part of the commercially available ingredients used (e.g., as a solvent or remnant of production), or, in order to dissolve one or more other ingredients within the composition. Generally, this amount will preferably be below about 1 weight percent, more preferably less than 0.5 weight percent, and more preferably less than about 0.1 weight percent of the concentrate composition.

The composition may be prepared as a concentrate that contains a concentrated solution of the components described above, or as an "aqueous use dilution" wherein the above concentrate is combined with a sufficient amount of water to provide a solution that can be used with standard carpet cleaning equipment. In general, the aqueous use dilution can be prepared by diluting about 1 to 2 parts by weight of the concentrate with from about 99 to 98 parts by weight water.

The compositions of the invention can be prepared by combining the ingredients, heated or unheated, with stirring until a uniform mixture is obtained.

In the method of the invention, the composition described above can be applied to a carpet using cleaning methods known in the carpet cleaning art. A preferred method includes the step of hot water extraction, wherein the composition, e.g., an aqueous use dilution, can be delivered to a carpet via a high pressure pump. The spent composition is subsequently removed by a wet vacuum system. Cleaning of the carpet is performed during this flushing and rinsing process. When a composition is used to clean a soiled carpet, the cleaned carpet continues to exhibit at least a portion, and a large extent of, original stainblocking properties provided by treatment applied at the time of manufacture.

In the method of the invention, an optional subsequent step can be conducted on the cleaned carpet, the subsequent step comprising treating the carpet (e.g., treating by spraying, foaming, and the like) with a fluorochemical repellent to provide oil and water repellency and soil resistance. Suitable fluorochemical repellents include urethanes, acrylates, esters, ureas, carbodiimides, biurets, allophanates, guanidines and oxazolidinones, which are known in the carpet cleaning art.

The invention is further described by reference to the following examples, which are understood to be illustrative and non-limiting of the invention.

EXAMPLES

GLOSSARY OF MATERIALS USED IN EXAMPLES

Polymer I—To a 1-L reaction vessel equipped with reflux condenser, mechanical stirrer and thermometer were charged 7.0 g of sulfated castor oil (SCO) solution (70% solids) and 515.0 g of deionized water. This solution was heated to 95° C., and then a solution containing 198.0 g of methacrylic acid (MAA), 45.2 g of butyl acrylate (BA), 21.6 g of ammonium persulfate initiator and 50 g deionized water was added dropwise with stirring over a period of about 2 hours. The reaction mixture was further stirred for 3 hours at 90° C. and then was cooled to 50° C. The resultant copolymer solution was neutralized to a pH of about 4 by the addition of 25.2 g of 20% aqueous NaOH to give a methacrylic acid polymer component solution containing 33% (wt) solids having a monomer weight ratio of 80/18/2 MAA/BA/SCO.

Polymer II—The same synthesis and neutralization was run as in Polymer I, except that more butyl acrylate was used, giving a methacrylic acid polymer component solution containing 33% (wt) solids having a monomer weight ratio of 67/31/2 MAA/BA/SCO.

Polymer III—The same synthesis and neutralization was run as in Polymer I, except that less butyl acrylate was used, giving a methacrylic acid polymer component solution containing 33% (wt) solids having a monomer weight ratio of 87/10/3 MAA/BA/SCO.

Polymer IV—The same synthesis and neutralization was run as in Polymer I, except that only methacrylic acid was polymerized (i.e., the 100% homopolymer), giving a methacrylic acid polymer component solution containing 33% (wt) solids. 3M Brand FC-661 Stain Release Concentrate—a 29% (wt) aqueous solution containing a blend of methacrylic acid polymer component and partially sulfonated novolac resin (total solids in product contain about 83% methacrylic acid polymer component), available from 3M Co.

3M Brand FC-657 Stain Release Concentrate—a 30% (wt) aqueous solution of a methacrylic acid polymerized in the presence of a partially sulfonated novolac resin and sodium xylene sulfonate (total solids in product contains about 44% polymerized methacrylic acid), available from 3M Co.

3M Brand FC-670 Stain Release Concentrate—a 30% (wt) aqueous solution, of which 11.5% (wt) is polymethacrylic acid and 18.5% (wt) is sodium dodecylbenzene sulfonate (total solids in product contains about 38% polymerized methacrylic acid), available from 3M Co.

3M Brand FC-369 Stain Release Concentrate—a 34% (wt) aqueous solution containing a partially sulfonated novolac resin (contains no methacrylic acid-containing polymer), available from 3M Co.

SR-300 Stainblocker—a 30% (wt) solids aqueous solution of a stainblocker (contains no methacrylic acid-containing polymer), available from duPont de Nemours, Wilmington, Del.

SR-400 Stainblocker—a 30% (wt) solids aqueous solution of a stainblocker (contains no methacrylic acid-containing polymer), available from duPont de Nemours.

MO 678 Carpet—nylon 6 carpet, off-white color, having a face weight of 38–40 oz/yd$^2$ (1.3–1.4 kg/m$^2$), available from Shaw Industries, Dalton, Ga.

Godiva™ 42 Nylon 6,6 Carpet—nylon 6,6 carpet, blue color, having a face weight of 42 oz/yd$^2$ (1.5 kg/m$^2$), available from Queen Carpet, Dalton, Ga.

TEST PROCEDURES

Hot Water Extraction Procedure

This steam cleaning procedure used in the examples employs a specially designed laboratory machine to simulate the cleaning done by a professionally used hot water extracting machine which is described in the publication "Shampooing Carpet Samples with Carpet Board Cleaning Machine," *Floorcovering Test Methods*, CPT 106-1995 (Apr. 21, 1995) (available from 3M Company, St. Paul). This procedure describes the use of an automatic laboratory carpet board cleaning machine designed to reproduce approximately the cleaning of carpets through a hot water extraction process. The machine has three stations, each with a spray nozzle and vacuum cleaner head. The first station sprays the cleaning solution (i.e., aqueous use dilution) heated to 140° F. (60° C.) onto the carpet samples, each sample mounted onto a 12 inch by 12 inch (30 cm by 30 cm) square piece of press board. Immediately following, a vacuum head with a stroke rate of 1.5 in/sec (3.8 cm/sec) removes the cleaning solution from the carpet surface. One dry vacuuming is done and the last station is turned off (i.e., no rinsing was done). These alternating wet and dry passes simulate the overlap of a steam cleaning wand. A turntable carries the carpet sample boards from one station to another, rotating each board 90° between stations.

After cleaning, the wet carpet samples are allowed to dry at room temperature, flat and with the pile side up.

Minolta Chroma Meter™ Staining Test

Stain resistance was determined using the following test procedure. A 6 inch by 6 inch (15 cm by 15 cm) carpet sample is stained for 24 hours at room temperature by 20 mL of an aqueous staining solution contained inside a 2.5 inch (6.4 cm) diameter circular dam. The aqueous staining solution consists of 0.007% (wt) of Red Dye FD&C #40 in deionized water adjusted to a pH of 3.0 with 10% aqueous citric acid. Excess dye solution is then rinsed from the carpet sample by placing the dyed carpet sample under a stream of deionized water until the water runs clear. The rinsed carpet sample is then extracted to dampness using a Bock Centrifugal Extractor and is air-dried overnight at room temperature.

The degree of staining of the carpet sample is determined numerically by using a Minolta Chroma Meter™ CR-310 compact tristimulus color analyzer. The color analyzer measures red stain color autochromatically on the red-green color coordinate as a "delta a" (Δa) value as compared to the color of an unstained and untreated carpet sample. Values reported in the tables below are given to one place following the decimal point and represent the average of 3 measurements, unless stated otherwise. A greater Δa reading indicates a greater amount of staining from the red dye. Δa readings are rated on a 50-point scale, varying from 0 (no staining) to 50 (severe staining) (i.e., the lower the reading, the better the stain resistance).

3M Staining Test

In the 3M Staining Test, carpet is stained as described in the Minolta Chroma Meter™ Staining Test. However, in the 3M Staining Test, the degree of staining of the carpet sample is determined visually as described in U.S. Pat. No. 4,937,123 (Chang et al.). The rating scale used is an 8-point qualitative scale, with a rating of 8 representing excellent stain resistance, a rating of 7 representing good stain resistance, a rating of 5 representing satisfactory stain resistance, and lower readings representing fair to poor stain resistance (i.e., the higher the reading, the better the stain resistance).

Examples 1–8 and Comparative Examples C1–C10

Various stainblockers were evaluated to determine their ability to impart stainblocking performance when incorporated in the cleaning solution (i.e., the aqueous use dilution) used for hot water extraction.

In Examples 1–8 and Comparative Examples C1–C3 and C6–C8, the Hot Water Extraction Procedure was conducted on MO Nylon 6 and Godiva™ 42 Nylon 6,6 carpets (both of which were previously stainblocked at a carpet mill) with aqueous use dilutions containing 0.10 wt-% sodium tripolyphosphate sequestering agent, 0.04 wt-% sodium xylene sulfonate surfactant, and 0.10 wt-% of several stainblockers. After drying under ambient conditions, the Minolta Chroma Meter™ Staining Test and the 3M Staining Test were run to determine the stain resistance of each cleaned carpet.

In Comparative Examples C4 and C9, the same cleaning/reapplication and staining procedures were conducted as in Examples 1–8 except the stainblocker was omitted from the aqueous use dilution during the Hot Water Extraction Test.

In Comparative Examples C5 and C10, staining tests only were conducted on control production-stainblocked carpet samples (i.e., samples were not subjected to hot water extraction).

Results from these tests are presented in Table 1. Also included in Table 1 is a column depicting the percentage of methacrylic acid polymer component present in the aqueous use dilution.

TABLE 1

| Ex. | Carpet | Stainblocker | wt-% of MAA Polym. | Staining Test Used: Minolta, Δa | 3M |
|---|---|---|---|---|---|
| 1 | MO 678 | Polymer I | 0.100 | 8.9 | 4 |
| 2 | MO 678 | FC-661 | 0.083 | 10.0 | 4 |
| 3 | MO 678 | FC-657 | 0.044 | 20.8 | 2 |
| 4 | MO 678 | FC-670 | 0.038 | 14.3 | 3 |

TABLE 1-continued

| Ex. | Carpet | Stainblocker | wt-% of MAA Polym. | Staining Test Used: Minolta, Δa | 3M |
|---|---|---|---|---|---|
| C1 | MO 678 | FC-369 | 0 | 19.7 | 2 |
| C2 | MO 678 | SR-300 | 0 | 14.0 | 3 |
| C3 | MO 678 | SR-400 | 0 | 18.9 | 2 |
| C4 | MO 678 | (cleaned) | — | 38.3 | 1 |
| C5 | MO 678 | (contol) | — | 5.3 | 5.5 |
| 5 | Godiva ™ 42 | Polymer I | 0.100 | 5.2 | 5.5 |
| 6 | Godiva ™ 42 | FC-661 | 0.083 | 5.1 | 5.5 |
| 7 | Godiva ™ 42 | FC-657 | 0.044 | 13.3 | 3 |
| 8 | Godiva ™ 42 | FC-670 | 0.038 | 11.1 | 3.5 |
| C6 | Godiva ™ 42 | FC-369 | 0 | 14.3 | 3 |
| C7 | Godiva ™ 42 | SR-300 | 0 | 15.4 | 2.5 |
| C8 | Godiva ™ 42 | SR-400 | 0 | 21.1 | 2 |
| C9 | Godiva ™ 42 | (cleaned) | — | 22.1 | 1.5 |
| C10 | Godiva ™ 42 | (control) | — | 1.9 | 7 |

The data in Table 1 show that FC-661 and Polymer I, stainblockers containing at least 80% methacrylic acid polymer component (i.e., provided at least 0.08% methacrylic acid polymer component in the aqueous use dilution), exhibited the best stainblocking performance after hot water extraction, with values approaching those for the control carpet. The performance of FC-657 and FC-670 stainblockers was lower, but these stainblockers provided only about half the level of methacrylic acid polymer component as Polymer I or FC-661. Also, these two methacrylic acid polymer components were polymerized in the presence of surfactants and/or partially sulfonated phenolic resin, which may have negatively affected the performance of the polymer. The other stainblockers, which did not contain methacrylic acid polymer component, performed relatively poorly in their ability to provide stainblocking properties after hot water extraction.

Examples 9–18 and Comparative Examples C11–C14

The stain resistance of FC-661 stainblocker was evaluated at various concentrations when incorporated in the aqueous use dilution used for hot water extraction.

In Examples 9–18 the Hot Water Extraction Procedure was conducted on MO Nylon 6 and Godiva™ 42 Nylon 6,6 carpets with aqueous use dilutions containing 0.1 wt-% sodium tripolyphosphate sequestering agent, 0.04 wt-% sodium xylene sulfonate surfactant, and FC-661 stainblocker at various weight percent solids, calculated on both stainblocker and on methacrylic acid polymer component levels. After drying under ambient conditions, the Minolta Chroma Meter™ Staining Test and the 3M Staining Test were run to determine the stain resistance of each cleaned carpet.

In Comparative Examples C11 and C13, the same cleaning/reapplication and staining procedures were conducted as in Examples 9–18 except the stainblocker was omitted from the cleaning solution during the Hot Water Extraction Test.

In Comparative Examples C12 and C14, staining tests only were conducted trol production-stainblocked carpet samples (i.e., samples were not subjected to hot water extraction). Results from these tests are presented in Table 2.

TABLE 2

| Ex. | Carpet | Concentration (wt %) of: FC-661 | MAA Polym. | Staining Tests Used: Minolta, Δa | 3M |
|---|---|---|---|---|---|
| 9 | MO 678 | 0.47 | 0.40 | 7.8 | 4.5 |
| 10 | MO 678 | 0.23 | 0.20 | 5.5 | 5.5 |
| 11 | MO 678 | 0.12 | 0.10 | 9.0 | 4 |
| 12 | MO 678 | 0.06 | 0.05 | 15.3 | 2.5 |
| 13 | MO 678 | 0.03 | 0.025 | 21.2 | 2 |
| C11 | MO 678 | — | (cleaned) | 38.3 | 1 |
| C12 | MO 678 | — | (control) | 5.3 | 5.5 |
| 14 | Godiva ™ 42 | 0.47 | 0.40 | 1.1 | 7.5 |
| 15 | Godiva ™ 42 | 0.23 | 0.20 | 0.7 | 7.5 |
| 16 | Godiva ™ 42 | 0.12 | 0.10 | 3.2 | 6.5 |
| 17 | Godiva ™ 42 | 0.06 | 0.05 | 8.3 | 4.5 |
| 18 | Godiva ™ 42 | 0.03 | 0.025 | 12.7 | 3 |
| C13 | Godiva ™ 42 | — | (cleaned) | 22.1 | 1.5 |
| C14 | Godiva ™ 42 | — | (control) | 1.9 | 7 |

The data in Table 3 show that the FC-661 stainblocker provided good stain resistance at concentrations as low as 0.06% stainblocker (or 0.05% methacrylic acid polymer component) in the aqueous use dilution. However, best stain resistance was achieved when the stainblocker was incorporated into the aqueous use dilution at a concentration of at least 0.12% (or 0.10% methacrylic acid polymer component).

Examples 19–26 and Comparative Examples C15–C18

Stainblockers containing various percentages of methacrylic acid, butyl acrylate and sulfated castor oil were evaluated to determine the effect of comonomer level in the methacrylic acid polymer component on stain resistance after cleaning/treating via hot water extraction.

In Examples 19–26, the Hot Water Extraction Procedure was conducted on MO Nylon 6 and Godiva™ 42 Nylon 6,6 carpets with aqueous use dilutions containing 0.1 wt-% sodium tripolyphosphate sequestering agent, 0.04 wt-% sodium xylene sulfonate surfactant, and 0. 1% solids of various methacrylic acid/butyl acrylate/sulfated castor oil copolymer components. After drying under ambient conditions, the Minolta Chroma Meter™ Staining Test and the 3M Staining Test were run to determine the stain resistance of each cleaned carpet.

In Comparative Examples C15 and C17, the same cleaning/reapplication and staining procedures were conducted as in Examples 19–26 except the methacrylic acid polymer component was omitted from the aqueous use dilution during the Hot Water Extraction Test.

In Comparative Examples C16 and C18, staining tests only were conducted on control production-stainblocked carpet samples (i.e., samples were not subjected to hot water extraction).

Results from these tests are presented in Table 3.

TABLE 3

| Ex. | Carpet | Stainblocker | Wt. Ratio of MAA/BA/ SCO | Staining Test Used: Minolta, Δa | 3M |
|---|---|---|---|---|---|
| 19 | MO 678 | Polymer IV | 100/0/0 | 9.7 | 4 |
| 20 | MO 678 | Polymer III | 87/10/3 | 12.8 | 3 |
| 21 | MO 678 | Polymer I | 80/18/2 | 12.9 | 3 |
| 22 | MO 678 | Polymer II | 67/31/2 | 15.7 | 2.5 |
| C15 | MO 678 | — | (cleaned) | 34.7 | 1 |
| C16 | MO 678 | — | (control) | 9.7 | 4 |
| 23 | Godiva ™ 42 | Polymer IV | 100/0/0 | 3.0 | 6.5 |
| 24 | Godiva ™ 42 | Polymer III | 87/10/3 | 2.0 | 7 |
| 25 | Godiva ™ 42 | Polymer I | 80/18/2 | 3.3 | 6.5 |
| 26 | Godiva ™ 42 | Polymer II | 67/31/2 | 2.9 | 6.5 |
| C17 | Godiva ™ 42 | — | (cleaned) | 19.6 | 2 |
| C18 | Godiva ™ 42 | — | (control) | 1.1 | 7.5 |

The data in Table 3 show that methacrylic acid polymer components containing up one-third comonomer by weight performed well on both nylon carpets after cleaning/reapplication via hot water extraction, indicating that a significant portion of the methacrylic acid in the methacrylic acid polymer component can be replaced with comonomer. For the MO 678 nylon 6 carpet, the methacrylic acid polymer component containing lower percentages of comonomer performed slightly better.

We claim:

1. A composition comprising:

(a) a methacrylic acid copolymer comprising monomeric units derived from
methacrylic acid, and
comonomer comprising butyl acrylate and a sulfated castor oil, and optionally further comprising one or more of sodium sulfostyrene, itaconic acid, a vinylidene monomer, a polyolefinic monomer, a heterocyclic monomer, a poly-carboxylic acid, a carboxylic acid ester, a carboxylic acid amide, a carboxylic acid nitrile, a carboxylic acid anhydride, or a mixture thereof;

(b) a sequestering agent; and (c) an anionic surfactant.

2. The composition of claim 1, further comprising a partially sulfonated novolac.

3. The composition of claim 2, wherein the methacrylic acid copolymer and the partially sulfonated novolac are present in a ratio of about 1:0 to 1:1, based on weight.

4. The composition of claim 1, wherein the composition comprises:

(a) about 0.094 to 0.234 weight percent of a methacrylic acid copolymer;

(b) about 0.078 to 0.109 weight percent of a sequestering agent; and (c) about 0.031 to 0.063 weight percent of an anionic surfactant.

5. The composition of claim 4, further comprising about 0.016 to 0.078 weight percent of a partially sulfonated novolac resin.

6. The composition of claim 1, wherein the sequestering agent comprises EDTA or a salt thereof, citric acid or a salt thereof, boric acid or a salt thereof, nitrilotriacetic acid or a salt thereof, an alkali metal orthophosphate, an alkali metal tripolyphosphate, an alkali metal pyrophosphate, an alkali metal hexametaphosphate, or a mixture thereof.

7. The composition of claim 1, wherein the sequestering agent comprises sodium tripolyphosphate.

8. The composition of claim 1, wherein the anionic surfactant comprises sodium lauryl sulfate, sodium myristyl sulfate, sodium lauryl ether (2) sulfate, sodium decyl sulfate, ammonium myristyl ether sulfate, sodium nonylphenol polyglycol ether (15) sulfate, sodium $C_{16}$–$C_{18}$ α-olefin sulfonate, sodium dodecylbenzenesulfonate, sodium naphthyl sulfonate, sodium dihexyl sulfosuccinate, sodium laurate, sodium stearate, sodium ether (5) stearate, potassium ricinoleate (potassium 12-hydroxy-9-octadecanoate), sodium myristoyl sarcosine, sodium N-methyl-N-oleyl taurate or a mixture thereof.

9. The composition of claim 1, wherein the anionic surfactant comprises sodium xylene sulfonate.

10. The composition of claim 1, further comprising a defoaming agent, a fragrance, or a mixture thereof.

11. The composition of claim 1, wherein the methacrylic acid copolymer, the sequestering agent and the anionic surfactant are present in a weight ratio of about 4:2:1 to about 1:2:1.

12. The composition of claim 1, wherein the composition comprises essentially no organic solvent.

13. The composition of claim 1, wherein the composition comprises less than about 1 weight percent organic solvent.

14. The composition of claim 1, wherein the composition comprises less than about 0.5 weight percent organic solvent.

15. The composition of claim 1, wherein the composition comprises less than about 0.1 weight percent organic solvent.

16. The composition of claim 1 further comprising water.

17. The composition of claim 1 wherein the one or more comonomer does not include acrylic acid.

18. A composition comprising:

(a) a methacrylic acid copolymer comprising monomeric units derived from
methacrylic acid, and
comonomer comprising an alkyl acrylate, a sulfated castor oil, sodium sulfostyrene, itaconic acid, a vinylidene monomer, a polyolefinic monomer, a heterocyclic monomer, a poly-carboxylic acid, a carboxylic acid ester, a carboxylic acid amide, a carboxylic acid nitrile, a carboxylic acid anhydride, or a mixture thereof;

(b) a sequestering agent, (c) an anionic surfactant, and (d) a partially sulfonated novolac.

19. The composition of claim 18, wherein the methacrylic acid copolymer component and the partially sulfonated novolac are present in a ratio of about 1:0 to 1:1, based on weight.

20. A composition comprising:

(a) a methacrylic acid copolymer comprising monomeric units derived from
methacrylic acid, and
comonomer comprising an alkyl acrylate, a sulfated castor oil, sodium sulfostyrene, itaconic acid, a vinylidene monomer, a polyolefinic monomer, a heterocyclic monomer, a poly-carboxylic acid, a carboxylic acid ester, a carboxylic acid amide, a carboxylic acid nitrile, a carboxylic acid anhydride, or a mixture thereof;

(b) a sequestering agent; and (c) an anionic surfactant; wherein the copolymer comprises
about 0.094 to 0.234 weight percent methacrylic acid copolymer;
about 0.078 to 0.109 weight percent sequestering agent; and
about 0.031 to 0.063 weight percent anionic surfactant.

21. The composition of claim 20, further comprising about 0.016 to 0.078 weight percent of a partially sulfonated novolac resin.

22. A composition comprising:

(a) a methacrylic acid copolymer comprising monomeric units derived from
methacrylic acid, and
comonomer comprising an alkyl acrylate, a sulfated castor oil, sodium sulfostyrene, itaconic acid, a vinylidene monomer, a polyolefinic monomer, a heterocyclic monomer, a poly-carboxylic acid, a carboxylic acid ester, a carboxylic acid amide, a carboxylic acid nitrile, a carboxylic acid anhydride, or a mixture thereof;

(b) a sequestering agent, (c) an anionic surfactant, wherein the methacrylic acid copolymer, the sequestering agent, and the anionic surfactant are present in a weight ratio of about 4:2:1 to about 1:2:1.

23. A method of cleaning a fibrous polyamide substrate without substantial loss of stainblocking properties, the method comprising:

(a) hot water-extracting the substrate with a composition comprising:
(i) a methacrylic acid polymer;
(ii) a sequestering agent; and
(iii) an anionic surfactant; and (b) allowing the substrate to dry.

24. The method of claim 23 wherein the comonomer comprises monomeric units derived from monomers comprising an alkyl acrylate, sulfated castor oil, or a combination thereof.

25. The method of claim 24 wherein the comonomers comprise butyl acrylate and sulfated castor oil.

26. The method of claim 23 wherein the composition comprises:

(a) about 0.094 to 0.234 weight percent of a methacrylic acid polymer;

(b) about 0.078 to 0.109 weight percent of a sequestering agent; and (c) about 0.031 to 0.063 weight percent of an anionic surfactant.

27. The method of claim 26 wherein the composition further comprises about 0.016 to 0.078 weight percent of a partially sulfonated novolac resin.

28. The method of claim 23, further comprising treating the cleaned fibrous polyamide substrate with a fluorochemical.

29. The method of claim 23 wherein the methacrylic acid polymer comprises monomeric units derived from comonomers comprising
methacrylic acid, and
one or more comonomer comprising an alkyl acrylate, a sulfated castor oil, sodium sulfostyrene, itaconic acid, a vinyl monomer, a vinylidene monomer, a polyolefinic monomer, a heterocyclic monomer, a poly-carboxylic acid, a carboxylic acid ester, a carboxylic acid amide, a carboxylic acid nitrile, a carboxylic acid anhydride, or a mixture thereof.

30. The method of claim 23 wherein the composition further comprises a partially sulfonated novolac.

31. The method of claim 23 wherein the methacrylic acid polymer component and the partially sulfonated novolac are present in the composition in a ratio of about 1:0 to 1:1, based on weight.

32. The method of claim 23 wherein the sequestering agent comprises EDTA or a salt thereof, citric acid or a salt thereof, boric acid or a salt thereof, nitrilotriacetic acid or a salt thereof, an alkali metal orthophosphate, an alkali metal tripolyphosphate, an alkali metal pyrophosphate, an alkali metal hexametaphosphate, or a mixture thereof.

33. The method of claim 23 wherein the sequestering agent comprises sodium tripolyphosphate.

34. The method of claim 23 wherein the anionic surfactant comprises sodium lauryl sulfate, sodium myristyl sulfate, sodium lauryl ether (2) sulfate, sodium decyl sulfate, ammonium myristyl ether sulfate, sodium nonylphenol polyglycol ether (15) sulfate, sodium $C_{16}$–$C_{18}$ α-olefin sulfonate, sodium dodecylbenzenesulfonate, sodium naphthyl sulfonate, sodium dihexyl sulfosuccinate, sodium laurate, sodium stearate, sodium ether (5) stearate, potassium ricinoleate (potassium 12-hydroxy-9-octadecanoate), sodium myristoyl sarcosine, sodium N-methyl-N-oleyl taurate or a mixture thereof.

35. The method of claim 23 wherein the anionic surfactant comprises sodium xylene sulfonate.

36. The method of claim 23 wherein the composition further comprises a defoaming agent, a fragrance, or a mixture thereof.

37. The method of claim 23 wherein the methacrylic acid polymer component, the sequestering agent and the anionic surfactant are present the composition in a weight ratio of about 4:2:1 to about 1:2:1.

38. The method of claim 23 wherein the composition comprises essentially no organic solvent.

39. The method of claim 23 wherein the composition comprises less than about 1 weight percent organic solvent.

40. The method of claim 23 wherein the composition comprises less than about 0.5 weight percent organic solvent.

41. The method of claim 23 wherein the composition comprises less than about 0.1 weight percent organic solvent.

42. The method of claim 23 wherein the composition further comprises water.

* * * * *